US006454195B1

(12) United States Patent
Amano et al.

(10) Patent No.: US 6,454,195 B1
(45) Date of Patent: Sep. 24, 2002

(54) INDUSTRIAL WASTE CRUSHING BIT

(75) Inventors: Masaharu Amano; Takanori Nagata, both of Hirakata; Kazuhide Okawa, Yawata; Toshisuke Isoya, Hadano, all of (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/536,715

(22) Filed: Mar. 28, 2000

(30) Foreign Application Priority Data

Mar. 30, 1999 (JP) ..... 11-087788
Oct. 15, 1999 (JP) ..... 11-294362

(51) Int. Cl.[7] ..... B02C 18/18

(52) U.S. Cl. ..... 241/186.4; 241/101.761; 144/241

(58) Field of Search ..... 241/294, 101.761; 144/24.12, 241, 218

(56) References Cited

U.S. PATENT DOCUMENTS

| | | | | |
|---|---|---|---|---|
| 3,089,353 A | * | 5/1963 | Craven | 76/108.1 |
| 4,542,943 A | | 9/1985 | Montgomery, Jr. | |
| 4,725,098 A | | 2/1988 | Beach | |
| 4,770,219 A | * | 9/1988 | Blackwell | 144/218 |
| 4,859,543 A | | 8/1989 | Greenfield et al. | |
| 5,044,570 A | * | 9/1991 | Montgomery | 241/294 |
| 5,064,127 A | * | 11/1991 | Hughes | 241/294 |
| 5,100,070 A | * | 3/1992 | Montgomery | 241/294 |
| 5,168,907 A | * | 12/1992 | Herrington | 241/294 |
| 5,240,192 A | * | 8/1993 | Tilby | 241/294 |
| 5,419,502 A | | 5/1995 | Morey | |
| 5,509,453 A | * | 4/1996 | Crockett | 144/218 |
| 5,582,353 A | * | 12/1996 | Willibald | 241/294 |
| 5,611,496 A | | 3/1997 | Fleenor | |
| 5,755,299 A | | 5/1998 | Langford, Jr. et al. | |
| 5,833,153 A | * | 11/1998 | Ackers | 241/294 |
| 5,852,272 A | | 12/1998 | Amano | |
| 5,967,248 A | | 10/1999 | Drake et al. | |
| 5,988,302 A | | 11/1999 | Sreshta et al. | |
| 6,000,153 A | | 12/1999 | Sollami | |
| 6,021,857 A | | 2/2000 | Birk et al. | |

FOREIGN PATENT DOCUMENTS

| | | |
|---|---|---|
| JP | 62-15718 | 4/1987 |
| JP | 63-284396 | 11/1988 |
| JP | 6-63414 | 8/1994 |
| JP | 11-509894 | 8/1999 |
| WO | WO 95/18678 | 7/1995 |
| WO | WO 97/06339 | 2/1997 |

OTHER PUBLICATIONS

Metals Handbook, 8th Edition, vol. 6, pp. 587–589.
Lincoln Electric—Hardfacing Product Selection Guide—Dec. 1992.
Lincoln Electric—Electrodes and Fluxes for Build–Up and Hardfacing—Apr. 1988.

* cited by examiner

*Primary Examiner*—Daniel C. Crane
(74) *Attorney, Agent, or Firm*—Armstrong, Westerman & Hattori, LLP.

(57) ABSTRACT

The invention relates to an industrial waste crushing bit capable of sufficiently exerting wear resistance from the initial stage of service and improving the service life at low cost. A super-hard member to be inserted in an opening formed in the tip of a bit body is formed into a plate shape and is secured to the bit body in such a manner that the plate faces of the plated-shaped super-hard member are placed in a direction virtually orthogonal to the rotational direction of the bit, with its side being exposed.

20 Claims, 13 Drawing Sheets

$P/Q = 0.1 - 0.5$

INDUSTRIAL WASTE CRUSHING BIT

TECHNICAL FIELD

The present invention relates to an industrial waste crushing bit used for finely crushing industrial wastes or the like.

BACKGROUND ART

Conventionally, an industrial waste crusher (also referred to as "tub grinder") used for crushing, for example, lumbers, etc. is comprised of a tub having an opening at the top to which industrial wastes are supplied, a rotary hammer placed on the bottom of the tub and a number of bits attached to the rotary hammer and is designed such that the industrial wastes fed into the tub are crushed by rotating the rotary hammer and discharged outside the machine. Here, with respect to the bit, as disclosed in U.S. Pat. No. 5,611,496 or in International Publication No. 95/18678, a bit, which has a structure in which a super-hard member is inserted in the tip of a bit body and brazed therein is generally used.

As illustrated in FIG. 12, in a bit 50 having the conventional structure, the bit body is constructed such that a head 52 having a virtually cone shape is provided at the leading end of a shank 51 through a flange 54, and a super-hard member 53 is inserted into and secured to a recessed section formed in the tip of the head 52 by brazing, etc. Moreover, the rear part of the shank 51 is died to form a thread which, in turn, is secured to a hammer body (not shown) by means of a nut. Here, with respect to the super-hard member 53, as illustrated in FIGS. 12(*b*) and 12(*c*) showing cross sections taken along lines E—E and F—F of FIG. 12(*a*), respectively, a member which has a circular shape in its cross section and a virtually column shape with its top machined into a round shape like a bullet is adopted.

Moreover, in the member having such a shape, in order to improve the service life of the bit tip against wear, build up welding is often applied to the entire bit tip or only to portions susceptible to wear by using a high-hardness material or a material mixed with high-hardness particles.

However, the problem with this type of bit is that an initial wear $G_1$ (FIG. 13(*a*)) which is created in the tip on the front side of the head 52 in the rotational direction and initial wear $G_2$ (FIG. 13(*b*)) which is created on the right and left sides of the head 52 in the rotational direction develop rapidly, causing a reduction in the brazed area for the super-hard member 53 and a lack of holding strength. As a result, the service life of the bit is shortened.

In order to cope with the above-mentioned problem, one proposal is to increase the length of the super-hard member so as to improve the service life against wear. However, increase in the length of the super-hard member results in high cost, as well as increase in the length of an exposed head of the super-hard member 53 due to the progress of the initial wear $G_1$ and $G_2$, thereby causing another problem in which the super-hard member 53 will be easy to break and to fall out of the bit body. Since the bit is used in a high-speed rotating state, if the super-hard member is broken or falls out during operation (while the bit is in rotation), the broken super-hard member might jump out of the industrial waste crusher, which is extremely dangerous.

Moreover, even when overlaying is applied to the entire bit tip or only to portions susceptible to wear by using a high-hardness material, since it cannot obtain wear resistance as high as the super-hard member, the tip on the front side, and the right and left sides of the head 52 in the rotational direction wear quickly at an early stage. Such wear on the head 52 leads to a significant decrease in the crushing efficiency.

Moreover, another problem is that since the recessed section into which the super-hard member 53 is inserted from the tip of the head 52 and brazed is available only on the tip side, gas generated at the time of brazing is hardly released, as a result of which a defective brazed tip tends to be formed.

The present invention is directed to overcoming the foregoing problems, and the primary object of the invention is therefore to provide an industrial waste crushing bit which is capable of sufficiently exerting wear resistance from the initial stage of service and has a longer service life at low cost.

DISCLOSURE OF THE INVENTION

The above object can be accomplished by an industrial waste crushing bit according to a first aspect of the invention, the industrial waste crushing bit comprising a bit body having an opening formed at the tip thereof, and a super-hard member inserted therein, wherein the super-hard member is formed into a virtually plate shape and the plate faces of the super-hard member are placed in a direction virtually orthogonal to the rotational direction of the bit, with the side faces of the super-hard member being exposed.

In accordance with the invention, the super-hard member having a virtually plate shape is embedded in the bit body with its side faces being exposed, and the plate faces of the super-hard member are placed in a direction virtually orthogonal to the rotational direction of the bit. Therefore, each exposed side face functions effectively in crushing materials to be crushed. In other words, this can solve the problem of progress of the initial wear $G_2$, which sufficiently contributes to exertion of wear resistance from the initial stage of service and extends the bit service life as a whole. Moreover, since an expensive super-hard material is used only for portions susceptible to wear, the amount of the super-hard material to be used can be saved, thereby realizing lowering of cost. It should be noted here that the "virtually plate shape" refers to a shape which has a width in the rotational direction that is shorter than a length in a direction orthogonal to the bit rotational direction and is a plate-like shape as a whole.

Preferably, the thickness of the virtually plate-shaped super-hard member is set in the range of 0.1 to 0.5 times the outer diameter of the head of the bit body. If the value is less than 0.1 times the outer diameter of the head, the thickness of the super-hard member becomes so thin that upon contact with materials to be crushed, the super-hard member is more likely to be damaged, failing to provide a sufficient wear-resistant effect. On the other hand, if the value exceeds 0.5 times the outer diameter of the head, the bit body portion supporting the super-hard member becomes relatively small, as a result of which when the bit body portion wears, the super-hard member is more likely to fall out, the bit head is more likely to be damaged, and the cost of the super-hard member becomes higher, resulting in inevitably higher cost as a whole bit.

With respect to the shape of each wall face of the opening, it is preferable to form each wall face into a tapered shape expanding inward while the super-hard member is so formed as to fit the shape of the wall face. Moreover, it is also preferable to form it into a shape having a recess inward at least on one side in the width direction of the super-hard member, while the super-hard member is so formed as to fit the shape of the wall face. With this arrangement, even when the bit is used in a high-speed rotating state, the super-hard member can be prevented, without fail, from falling out due to the centrifugal force accompanied with the rotation.

Furthermore, it is preferable that a theft be formed in the tip on the front side of the bit body in the rotational direction and that build up welding be applied to the theft by using a high-hardness material or a material mixed with high-hardness particles. With this arrangement, the initial wear occurring in the tip on the front side, and on the right and left sides of the bit body in the rotational direction can be suppressed without increasing the amount of expensive super-hard member, thereby improving the bit service life.

In the invention, the bit body is preferably comprised of a head at the front through a flange, and it is preferable to apply build up welding to at least the front side of these head and flange in the rotational direction by using a high-hardness material or a material mixed with high-hardness particles. This arrangement improves wear resistance at least on the front side of the head and the flange in the rotational direction, the place with which materials to be crushed come into contact, thereby preventing the attached bit body from becoming unstable due to wear on the flange and the crushing efficiency from decreasing, and further lengthening the service life.

Moreover, it is preferable to put a mark in the lower part at least on either one of the side faces of the super-hard member in the width direction, indicating a limit position beyond which the danger of falling-out of the super-hard member due to wear of the bit body is expected. Although the super-hard member will finally fall out of the bit body thereby to finish its service life and its limit of wear when it falls out varies depending upon the size and shape of the head and the super-hard member, it can be judged through experience to what extent of exposure of the super-hard member due to wear on the front side of the bit body in the rotational direction causes the super-hard member to fall out. Therefore, by putting the mark in the lower part at least on either one of the side faces of the super-hard member in the width direction, indicating a limit position beyond which the danger of falling-out of the super-hard member is expected due to wear of the bit body, that is the position in height determined based upon the above-mentioned experience, even an unskilled worker can easily make a judgment as to the expiration of the service life and avoid the danger of falling-out of the super-hard member during operation (while the bit is in rotation).

Moreover, in the invention, the bit body and the super-hard member are preferably joined to each other by means of brazing.

According to a second aspect of the invention, there is provided an industrial waste crushing bit, the industrial waste crushing bit comprising a bit body having an opening formed at the tip thereof, and a super-hard member inserted therein, wherein the super-hard member is formed into a virtually plate shape and the plate faces of the super-hard member are placed in a direction virtually orthogonal to the rotational direction of the bit, with the front face of the super-hard member in the rotational direction being formed into a slanting shape having the width in the vicinity of the tip set wider than the width of the base, while the front face in the tip of the super-hard member being exposed.

In the invention, the width in the vicinity of the tip of the super-hard member is set wider than the width of its base, and the front face in the tip of the super-hard member in the rotational direction is exposed from the bit body so that the front face of the super-hard member in the rotational direction works effectively in crushing materials to be crushed while suppressing the initial wear occurring in the tip on the front side of the bit body in the rotational direction, as a result of which the crushing operation is efficiently carried out. Therefore, the invention enables suppression of initial wear occurring in the tip on the front side of the bit body in the rotational direction, sufficient contribution to exertion of wear resistance at the initial stage of service and extending of the service life as a whole. Moreover, since the expensive super-hard member is used only for portions susceptible to wear, lowering of cost can be attained, and the efficiency of crushing materials to be crushed can be improved. It should be noted that the super-hard member is secured to the bit body in a manner so as to expose its side faces, which can simultaneously suppress the initial wear occurring in the tip on the front side of the bit body in the rotational direction and the initial wear occurring on the right and left sides thereof in the rotational direction and consequently, increase the service life.

In the invention, the exposed part on the tip front face of the super-hard member in the rotational direction is preferably made flush with the front face of the bit body.

In the invention, the bit body is preferably comprised of a head at the front through a flange, and it is preferable to apply build up welding to at least the front side of these head and flange in the rotational direction by using a high-hardness material or a material mixed with high-hardness particles. Moreover, it is preferable to put a mark in the lower part at least on either one of the side faces of the super-hard member in the width direction, indicating a limit position beyond which the danger of falling-out of the super-hard member due to wear of the bit body is expected. Furthermore, the bit body and the super-hard member are preferably joined to each other by means of brazing. With respect to the super-hard member, it is preferable to use a super-hard material that is formed by combining one or more high-hardness elements selected from the group consisting of carbide, nitride, boride and diamond with a metal.

BEST MODE FOR CARRYING OUT THE INVENTION

Referring now to the accompanying drawings, an industrial waste crushing bit will be concretely described according to embodiment of the invention.

(First Embodiment)

Figure 1:
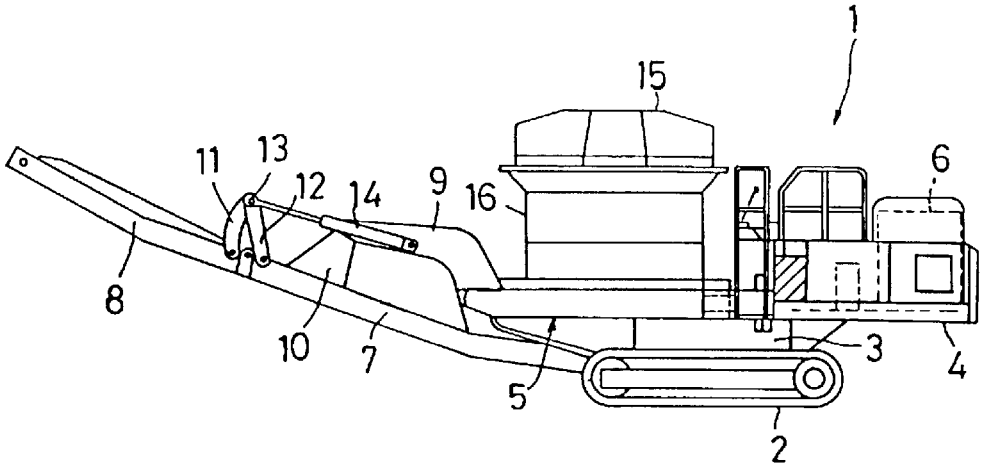
FIG. 1(*a*) is a side view, and FIG. 1(*b*) is a plan view of a wood crusher according to a first embodiment of the invention.
Figure 1:
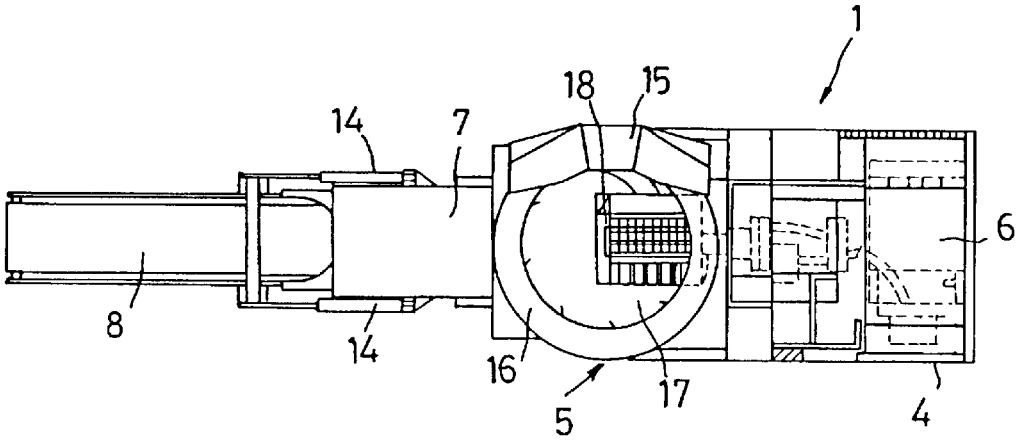

FIGS. 1(*a*) and 1(*b*) are a side view and a plan view, respectively, of a wood crusher according to a first embodiment of the invention.

In a wood crusher 1of the present embodiment, a turning base 4 is rotatably provided above a travelling body 3 which travels by means of crawler belts 2, and a crusher body 5 is mounted on the front side of the turning base 4 while an engine 6 and a power transmission mechanism are mounted on the rear side thereof. Below the crusher body 5, the base end of a first conveyor 7 is supported at the turning base 4, and the base end of a second conveyor 8 is pivotally supported at the leading end of the first conveyor 7 so as to freely swing in the vertical direction. Here, the leading end of the first conveyor 7 is supported by overhang beams 9 secured to the turning base 4,and lifting beams 10. Moreover, the second conveyor 8 is supported in a manner so as to swing and be folded with respect to the first conveyor 7 by arms 11 each being secured to the base end of the second conveyor 8, links 12 each being pivotally supported at the leading end of the first conveyor 7, hydraulic cylinders 14 each being provided between the overhang beam 9 and a pin 13 which connects the respective other ends of the arm 11 and link 12.

In the crusher body 5,there are provided a rotary tub 16 having an opening at the top with a scattering preventive cover 15 and a table 17 placed on the bottom of the tub 16, and a hammer mill 18 is supported and placed inside an opening of the table 17 so as to freely rotate around the horizontal shaft.

Figure 2:
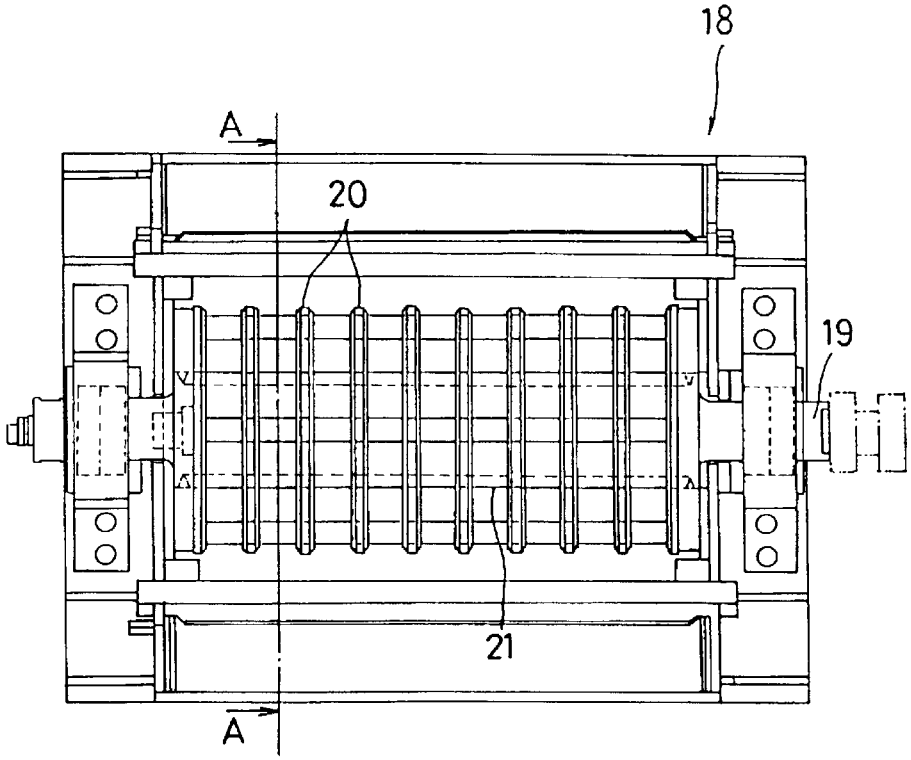
FIG. 2 is an enlarged plan view of a hammer mill.

FIG. 2 shows an enlarged plan view of the hammer mill 18. Moreover, FIG. 3(*a*) shows a cross-sectional view taken along line A—A of FIG. 2, and FIG. 3(*b*) shows an arrangement of hammer bits.

As illustrated in these Figures, the hammer mill 18 comprises a main shaft 19 rotatively driven by a motor, a plurality of plates 20 arranged along the main shaft 19 and hubs 21 holding the plates 20 at predetermined intervals. A plurality of hammers 22 are pivotally supported at each plate 20 so as to freely swing, and a hammer bit (bit) 23 is attached to each hammer 22 in a manner so as to slightly tilt with respect to the rotational direction.

Figure 3:
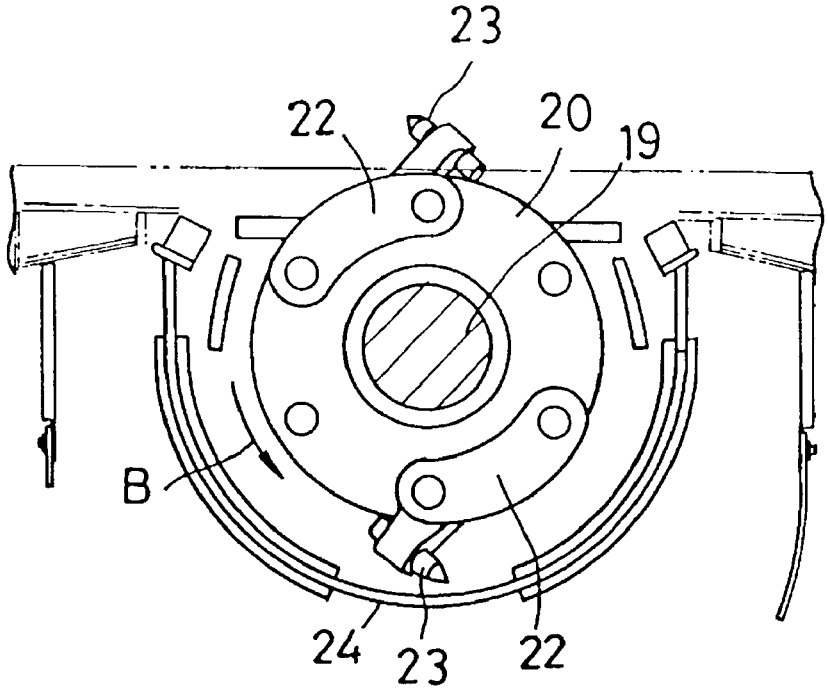
FIG. 3(*a*) is a cross-sectional view taken along line A—A of FIG. 2, and FIG. 3(*b*) is an explanatory view showing the arrangement of hammer bits.
Figure 3:
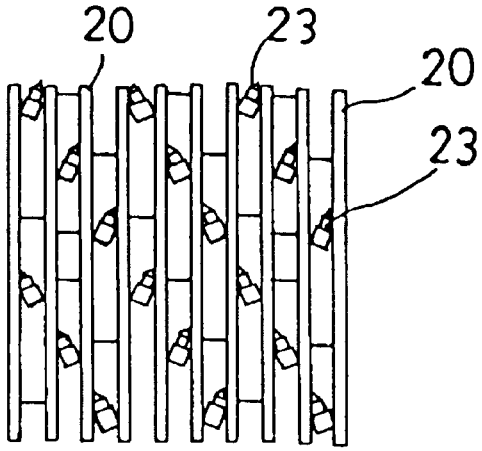

The hammer mill 18 is rotated in the direction of arrow B (see FIG. 3(*a*)) inside a screen 24 by the rotation of the main shaft 19, and during the rotation, lumbers casted into the tub 16 as materials to be crushed are crushed by the cooperative operation of the screen 24 and the bits 23. Thus, when the materials to be crushed become smaller than the size of the opening of the screen 24, they are allowed to fall downward through the opening of the screen 24.The crushed materials thus fallen downward are let out of the machine by means of the first conveyor 7 and the second conveyor 8.

Figure 4:
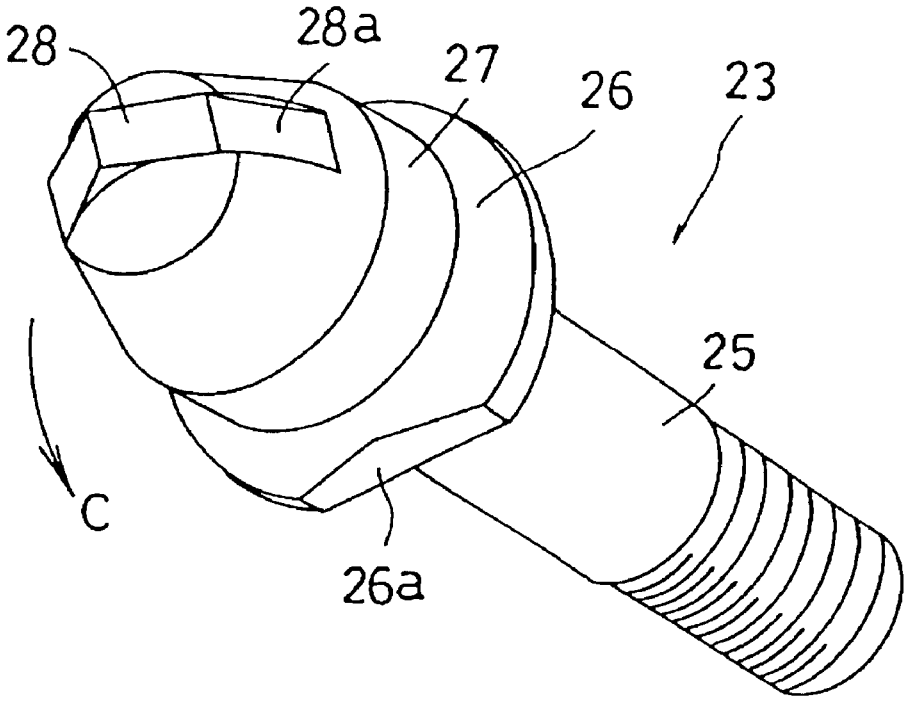
FIG. 4 includes views showing a bit of the first embodiment, FIG. 4(*a*) is an entire perspective view of the bit, and FIG. 4(*b*) is a perspective view of a super-hard member.
Figure 4:
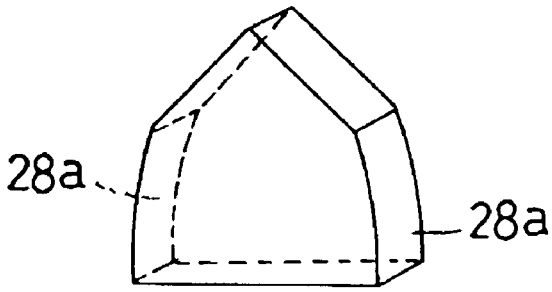

As illustrated in FIG. 4, the bit 23 to be attached to the hammer 22 is comprised of a bit body having a head 27 in a virtually cone shape at the leading end of a shank 25 through a flange 26 and a super-hard member 28 which is inserted into and secured to a recessed section (an opening) formed in the tip of the head 27 of the bit body by brazing. The outer peripheral surface of the rear part of the shank 25 is died to form a thread which, in turn, is secured to the body of the hammer 22 by means of a nut.

The opening into which the super-hard member 28 is inserted is formed over the entire width of the bit 23 in a direction virtually orthogonal to the rotational direction (the direction indicated by arrow C in FIG. 4). Moreover, as illustrated in FIG. 4(*b*), the super-hard member 28 to be inserted into the opening is formed into a plate-shaped virtually pentagonal column like a piece of Japanese chess (Shogi), and both side faces 28 a there of are exposed and made flush with the side faces of the head 27 of the bit body when placed in the opening of the bit body. Here, a notch 26 a is provided on the front side of the flange 26 of the bit body in the rotational direction and is used so as to adjust the orientation of the bit 23 when attached to the hammer 22.

Figure 5:
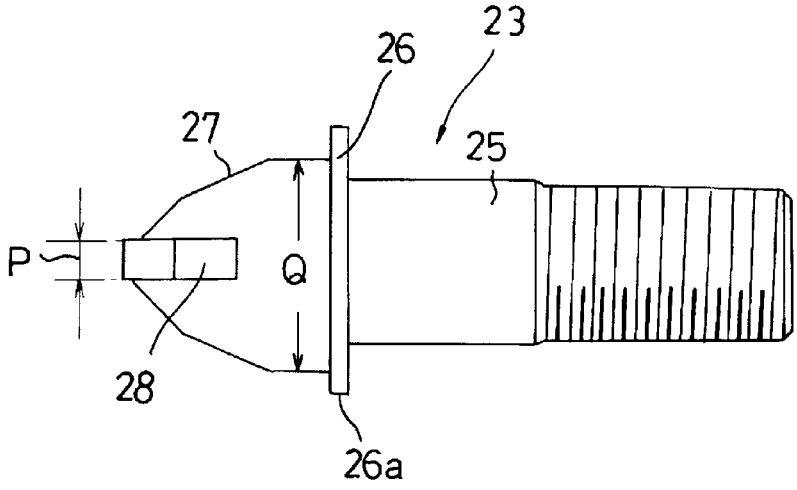
FIG. 5 is an explanatory drawing that shows the relationship between the dimension of the super-hard member and the dimension of a head.
Figure 6:
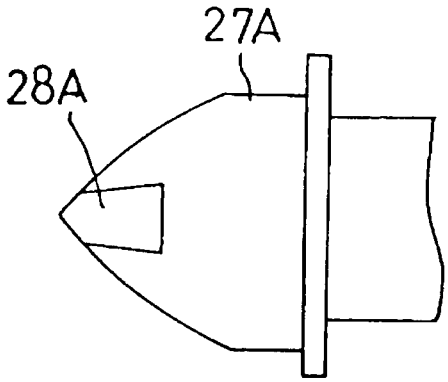
FIGS. 6(*a*), 6(*b*) and 6(C) are drawings that show shapes of super-hard members in first through third modified examples of the first embodiment.
Figure 6:
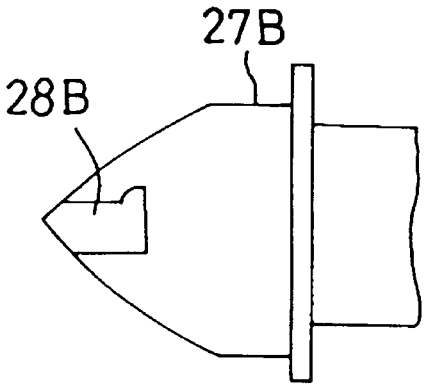
Figure 6:
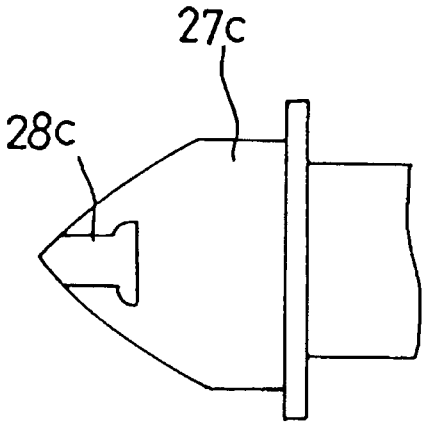
Figure 12:
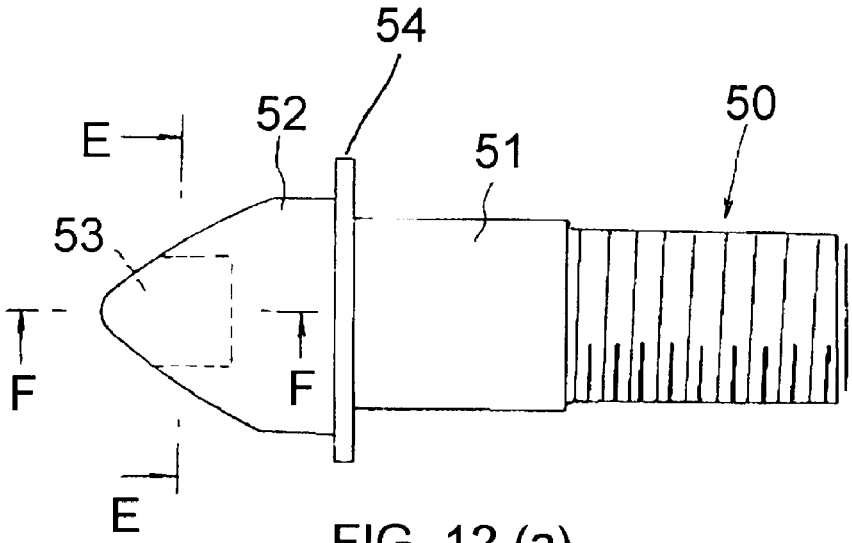
FIGS. 12(*a*), 12(*b*) and 12(*c*) are views each showing the structure of a conventional bit.
Figure 12:
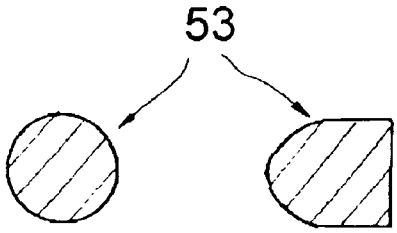
Figure 13:
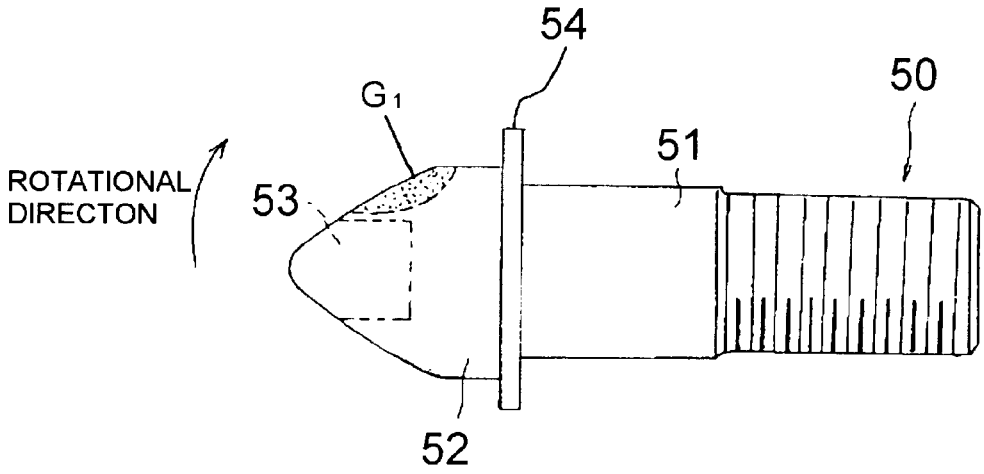
FIGS. 13(*a*) and 13(*b*) are explanatory drawings that show problems with the conventional bit.
Figure 13:
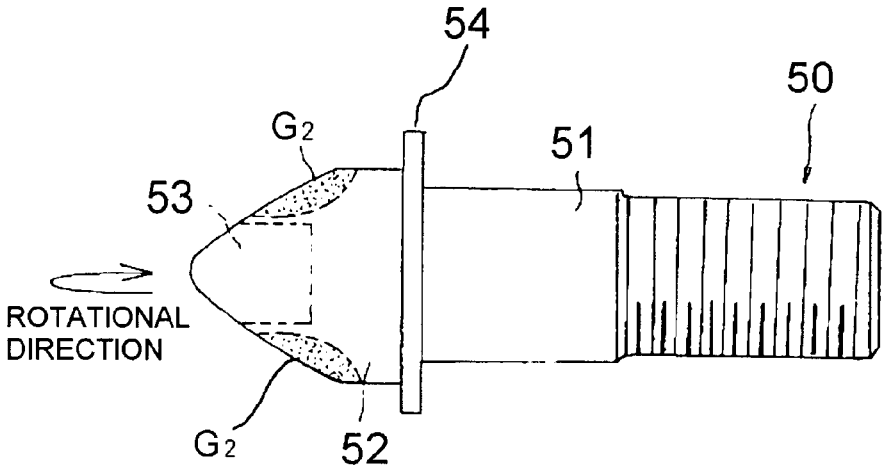

As illustrated in FIG. 5, the width P of the super-hard member 28 is preferably set in the range of 0.1 to 0.5 times the diameter Q of the base of the head 27. This range of numeric values, 0.1 to 0.5, is determined, as shown in Table 1, based upon the result of service life test with an actual machine. In the is test, bits corresponding to respective levels (levels 1 to 6) of the present embodiment were attached to a wood crusher 1 as shown in FIGS. 1 to 3, and the remaining service life after the operation of 300 hours were measured. The ratio of service life is a value obtained in comparison with a conventional product. Here, as shown in FIG. 6(*c*), level 6 is a super-hard member of level 5 with a protrusion attached thereto (will be described later). And the conventional product has a structure of one in FIG. 12.

TABLE 1

RESULT OF SERVICE LIFE TEST BY AN ACTUAL MACHINE

| LEVEL | P/Q VALUE | LIFE RATIO |
|---|---|---|
| 1 | 0.09 | 0.95 |
| 2 | 0.26 | 2.2 |
| 3 | 0.39 | 2.8 |
| 4 | 0.51 | 3.6 |
| 5 | 0.56 | FELL OUT AFTER AN ELAPSE OF 250 HOURS |
| 6 | 0.56 | 3.8 |
| CONVENTIONAL PRODUCT | 0.49 | 1.0 |

In accordance with the bit 23 of the present embodiment, both side faces 28*a* of the super-hard member 28 in the rotational direction work effectively in crushing materials to be crushed, which sufficiently contributes to exertion of wear resistance from the initial stage of service and extends the service life as a whole. Moreover, since the expensive super-hard material is used only for portions susceptible to wear, the amount of the super-hard material to be used can be saved, there by realizing lowering of cost.

Moreover, setting of the P/Q value in the range of 0.1 to 0.5 can satisfy both functions of improving service life against wear and preventing the super-hard member 28 from falling out. In other words, as clearly shown in the test result of Table 1, the P/Q value less than 0.1 makes the thickness of the super-hard member 28 too thin, as a result of which the super-hard member is more likely to be damaged when it comes into contact with materials to be crushed, there by failing to provide a sufficient wear-resistant effect and the service life will be short. On the other hand, the P/Q value exceeding 0.5 makes the bit body portion supporting the super-hard member 28 relatively small, causing the super-hard member 28 to easily fall out.

FIGS. 6(*a*), 6(*b*) and 6(*c*) show side views of bits according to first to third modified examples of the present embodiment. These figures relate to shapes of the super-hard member, which ensure more prevention of falling-out of the super-hard member from the bit body.

In the first modified example shown in FIG. 6(*a*), the wall face of the opening formed in the tip of the head 27A is formed into a tapered shape which expands inward, and the super-hard member 28A is formed into a shape so as to fit the shape of the wall face. In the second modified example shown in FIG. 6(*b*), the wall face of the head 27B is formed into a shape having a recess inward on one side in the width direction of the super-hard member 28B, and the super-hard member 28B is formed into a shape so as to fit the shape of the wall face. In the third modified example shown in FIG. 6(*c*), the wall face of the head 27C is formed into a shape having a recess on both sides in the width direction of the super-hard member 28C, and the super-hard member 28C is formed into a shape so as to fit the shape of the wall face. In either of the modified examples, the super-hard member has a shape expanding inward. Therefore, even if the bit is used in a high-speed rotating state, the super-hard member 28A, 28B or 28C will not jump outward due to the effect of the centrifugal force, and prevention of falling-out of the super-hard member can be attained without fail.

(Second Embodiment)

Figure 7:
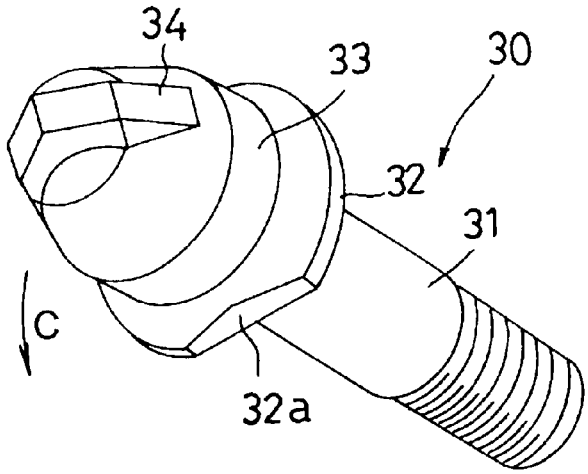
FIG. 7(*a*) is a perspective view of a bit, FIG. 7(*b*) is a side view thereof, and FIG. 7(*c*) is a perspective view of a super-hard member secured to the bit according to a second embodiment.
Figure 7:
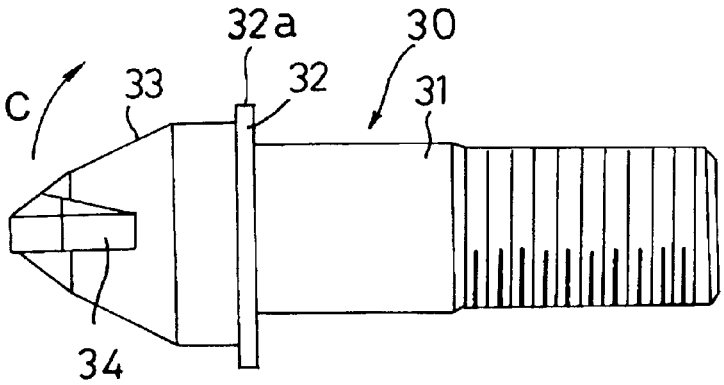
Figure 7:
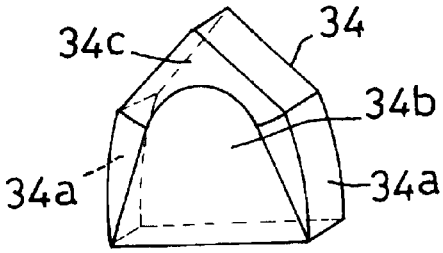

FIGS. 7(*a*) and 7(*b*) are a perspective view and a side view, respectively, of a bit, and FIG. 7(*c*) is a perspective view of a super-hard member attached to the bit according to a second embodiment of the invention.

The bit 30 of the second embodiment is comprised of a bit body having a head 33 in a virtually cone shape at the leading end of a shank 31 through a flange 32 and a super-hard member 34 which is inserted into and, by brazing, secured to a recessed section (an opening) formed in the tip of the head 33 of the bit body in a manner so as to expand from the inner side toward the tip side. It should be noted that a notch 32*a* is formed on the front side of the flange 32 in the rotational direction (the direction indicated by arrow C in FIG. 7) in the same manner as the first embodiment.

Similarly to the first embodiment, the super-hard member 34 is formed into a virtually pentagonal column shape as a whole. Moreover, the front face of the super-hard member 34 in the rotational direction is formed into a slanting shape with the width in the vicinity of the tip being set wider than the width of its base. More specifically, the super-hard member 34 is designed such that when the super-hard member 34 is inserted into the opening, the shape of the front face of the super-hard member 34 in the rotational direction forms a face 34*b* embedded in the head 33 and a face 34*c* exposed therefrom so that the two faces 34*b* and 34*c* form respective slanting shapes with a border line forming a ridge in-between. Moreover, both side faces 34*a* of the super-hard member 34 are exposed and made virtually flush with the side faces of the head 33 of the bit body when inserted into the opening, and the exposed face 34*c* on the front face in the rotational direction is formed into a shape so as to be made virtually flush with the front face of the head 33 of the bit body in the rotational direction.

In accordance with the bit 30 having the above-mentioned structure, the exposed face 34*c* on the front face of the super-hard member 34 in the rotational direction exposing from the head 33 of the bit body works effectively in crushing materials to be crushed while suppressing wear in the tip front side of the head 33.Moreover, both side faces 34*a* of the super-hard member 34 in the rotational direction work effectively in crushing materials to be crushed while suppressing the initial wear on the head 33. Therefore, such a super-hard member 34 sufficiently contributes to exertion of its wear resistance from the initial stage of service and suppresses wear on the head 33, thereby improving the service life and the crushing efficiency.

Figure 8:
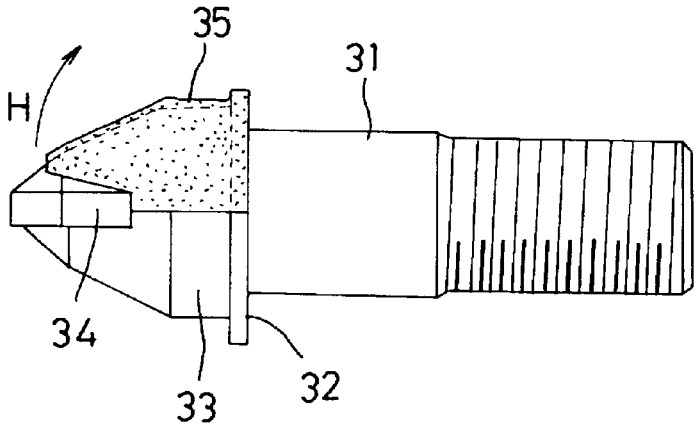
FIG. 8 is an explanatory drawing that shows build up welding applied to the bit of the second embodiment.

As illustrated in FIG. 8, in the bit 30 of the present embodiment, a surface overlay 35 is preferably formed on the front side of the head 33 and the flange 32 in the rotational direction by means of build up welding using a high-hardness material or a material mixed with high-hardness particles. This arrangement further improves wear resistance on the front side of the head 33 and the flange 32 in the rotational direction where materials to be crushed come into contact and, as a result, further increases the service life. Moreover, the suppression of wear on the flange 32 ensures a stable attachment of the bit 30 to the hammer 22 and consequently, improves the crushing efficiency.

When applying build up welding to the head 33 and the flange 32 of the bit body as described above, a dummy member (not shown) is first inserted into the opening of the head 33into which the super-hard member 34 is to be inserted, and surface build up welding is then applied to the front side of the head 33 and the flange 32 in the rotational direction. Thereafter, the dummy member is removed therefrom, and the super-hard member 34 is inserted and brazed therein. Here, no surface build up welding is applied to the notch 32*a* of the flange 32.

(Third Embodiment)

Figure 9:
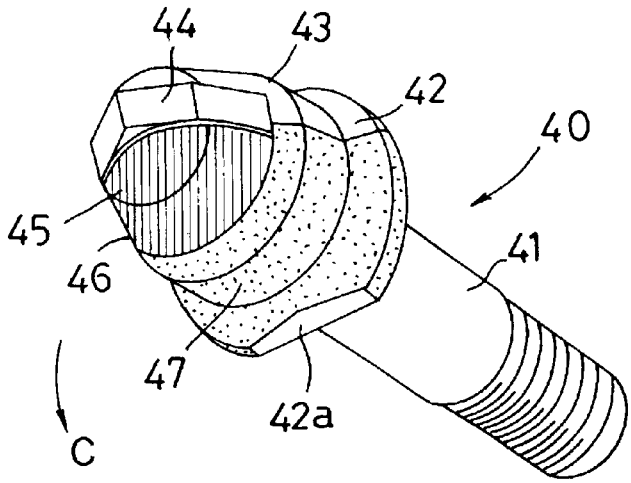
FIG. 9(*a*) is a perspective view of a bit, FIG. 9(*b*) is a side view thereof, and FIG. 9(*c*) is a perspective view of a super-hard member secured to the bit according to a third embodiment.
Figure 9:
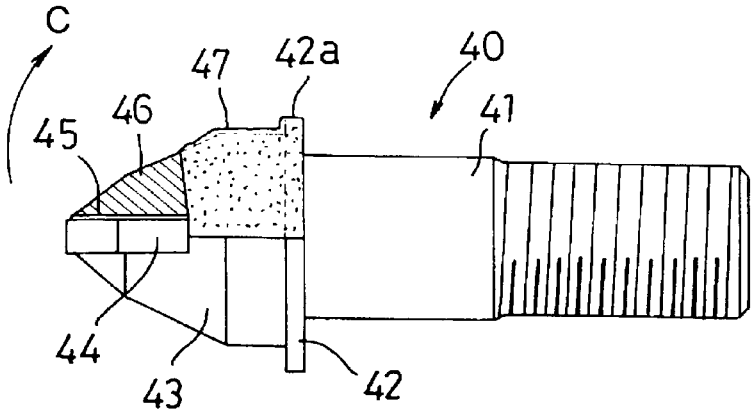
Figure 9:
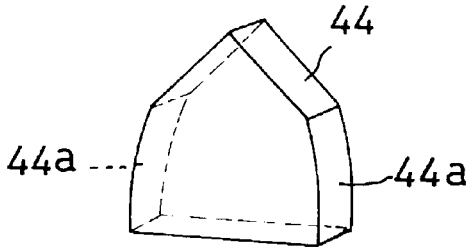

FIGS. 9(*a*) and 9(*b*) are a perspective view and a side view, respectively, of a bit, and FIG. 9(*c*) is a perspective view of a super-hard member attached to the bit according to a third embodiment of the invention.

The bit 40 of the third embodiment is comprised of a bit body having a head 43 in a virtually cone shape at the leading end of a shank 41 through a flange 42 and a super-hard member 44which is inserted into and secured to a recessed section (an opening) formed in the tip of the head 43 of the bit body by brazing.

Similarly to the first and second embodiments, the super-hard member 44 is a plate-shaped virtually pentagonal column and has side faces 44*a* being exposed and made virtually flush with the side faces of the head 43 of the bit body when inserted into the opening formed over the entire width in a direction orthogonal to the rotational direction of the bit.

In the head 43 of the bit body, a theft 45 is formed in front of the opening in the rotational direction, and an overlay 46 is formed in the theft 45 by build up welding using a material mixed with high-hardness particles. Moreover, build up welding using a high-hardness material is applied to at least the front side of a portion of the head 43which is below the theft 45 and the flange 42 in the rotational direction to form a surface overlay 47.

When forming the overlay 46 and surface overlay 47, a dummy member (not shown) is first inserted into the opening and the overlay 46 and surface overlay 47are then formed. Thereafter, the dummy member is removed therefrom, and the super-hard member 44 is inserted into the opening and then brazed. Here, although a notch 42*a* is provided on the front side of the flange 42 in the rotational direction so as to adjust the orientation of the bit 40 when attached to the hammer 22, no surface build up welding is applied to the notch 42*a*.

In accordance with the bit 40 having such a structure, the overlay in the theft 45 which is on the front side of the super-hard member 44, and both side faces 44*a* of the super-hard member 44 in the rotational direction work effectively in crushing materials to be crushed, thereby sufficiently contributing to exertion of wear resistance from the initial stage of service while suppressing wear on the head 43 so that the bit service life will be improved. Moreover, applying of surface build up welding to the head 43 and the flange 42 improves wear resistance on the front side there of in the rotational direction and further lengthens the service life. Further, suppression of wear in the flange 42 ensures a stable attachment of the bit 40 to the hammer 22 and, as a result, improves the crushing efficiency.

Figure 10:
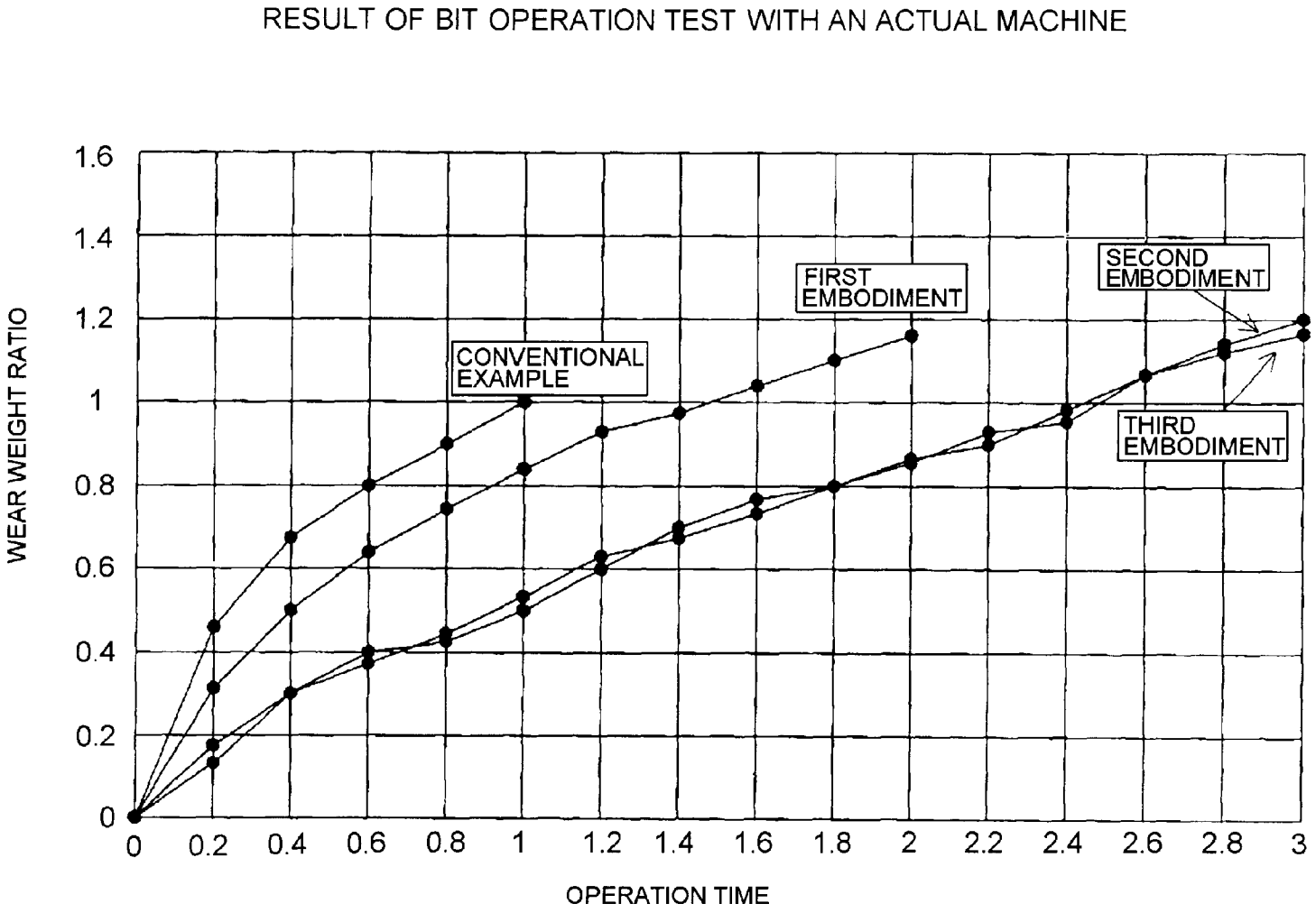
FIG. 10 is a graph that shows the result of an operation test on the bits with an actual machine.

Next, in order to confirm the wear resistance of the bit in each embodiment, a bit operation test with an actual machine was carried out. FIG. 10 shows the result of the test. In this operation test, the bits of the first embodiment, second embodiment, third embodiment and comparative example (a structure shown in FIG. 12) were installed in the wood crusher 1 as shown in FIGS. 1 to 3, and the amount of wear and operation time of the bit until reaching its wear limit (falling-out of the super-hard member) were measured. Here, the amount wear and operation time are represented by ratios obtained based upon a wear limit point in the bit having the conventional structure. Moreover, the bit 30 of the second embodiment has front side of the head 33 and the flange 32 in the rotational direction to which the surface overlay.

In the bits of the first, second and third embodiments, since each of the super-hard members 28, 34 and 44 sufficiently contributes to exertion of wear resistance from the initial stage of service and wear on the bit body is entirely and uniformly created, the operation time of the bit of each embodiment until reaching the wear limit point is longer and its amount of wear has increased more than those of the bit of the conventional structure. Moreover, since build up welding is applied to the bits of the second and third embodiments, it is clear that their service life has improved further compared to the bit of the first embodiment.

Figure 11:
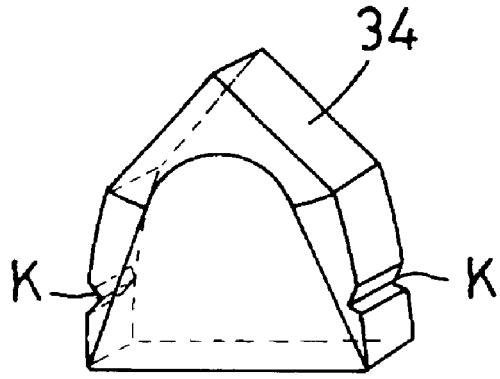
FIGS. 11(*a*) and 11(*b*) are explanatory views that show a mark on each side face of the super-hard member in the width direction.
Figure 11:
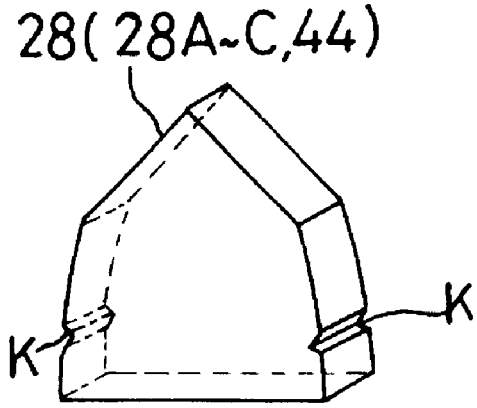

As illustrated in FIGS. 11(*a*) and 11(*b*), in the super-hard members 28, 28A, 28B, 28C, 34 and 44 of the respective embodiments, it is preferable to put a mark K indicative of the wear limit point on each side face of the head in the width direction, that is a limit position beyond which the danger of falling-out of the super-hard member is expected. By placing the mark K on each side face of the super-hard member in the width direction, it enables an easy judgement of a limit position in height indicative of the extent of exposure of the super-hard member due to wear on the front side of the head in the rotational direction which causes falling-out of the super-hard member. Consequently, the danger of falling-out of the super-hard member during operation (while the bit is in rotation) can be avoided without fail.

Moreover, in order to improve the brazing strength of the super-hard member to the bit body in the respective embodiments, binder used in a super-hard material constituting the super-hard member is optimized to prevent the super-hard member from falling out.

What is claimed is:

1. An industrial waste crushing bit for attachment to a hammer of an industrial waste crusher, wherein said hammer is rotated in a specified rotational direction so as to contact and crush waste product to be crushed in the crusher, comprising a bit body having a shank and a virtually conically shaped head at an end of the shank, an opening formed at the tip of the head and a super-hard member inserted therein, wherein the super-hard member is formed into a virtually plate shape having front and side faces and secured to the bit body in such a manner that the front faces of the super-hard member are placed in a direction virtually orthogonal to the rotational direction of the hammer, with the side faces of the super-hard member being exposed, and wherein the thick-ness in the width direction of the super-hard member is set in the range of 0.1 to 0.5 times a maximum outer diameter of the virtually conically shaped head of the bit body.

2. An industrial waste crushing bit for attachment to a hammer of an industrial waste crusher, wherein said hammer is rotated in a specified rotational direction so as to contact and crush waste product to be crushed in the crusher, comprising a bit body having a shank at one end and a virtually conically shaped head extending from the shank to the other end of said bit body, an opening formed at the tip of the head and a super-hard member inserted therein, wherein the super-hard member is formed into a virtually plate shape having front and side faces and secured to the bit body in such a manner that the front faces of the super-hard member are placed in a direction virtually orthogonal to the rotational direction of the hammer, with the side faces of the super-hard member being exposed, and wherein the opening formed at the tip of the head has a wall face formed into a tapered shape with the distance between wall faces expanding inward, and the super-hard member is formed into a shape so as to fit the shape of the wall face.

3. An industrial waste crushing bit for attachment to a hammer of an industrial waste crusher, wherein said hammer is rotated in a specified rotational direction so as to contact and crush waste product to be crushed in the crusher, comprising a bit body having a shank at one end and a virtually conically shaped head extending from the shank to the other end of said bit body, an opening formed at the tip of the head and a super-hard member inserted therein, wherein the super-hard member is formed into a virtually plate shape having front and side faces and secured to the bit body in such a manner that the front faces of the super-hard member are placed in a direction virtually orthogonal to the rotational direction of the hammer, with the side faces of the super-hard member being exposed, and wherein the opening has a wall face formed into a shape having a recess inward at least on one side in the width direction of the super-hard member, and the super-hard member is formed into a shape so as to fit the shape of the wall face.

4. An industrial waste crushing bit for attachment to a hammer of an industrial waste crusher, wherein said hammer is rotated in a specified rotational direction so as to contact and crush waste product to be crushed in the crusher, comprising a bit body having a shank and a virtually conically shaped head at all end of the shank, an opening formed at the tip of the head and a super-hard member inserted therein, wherein the super-hard member is formed into a virtually plate shape and secured to the bit body in such a manner that the font faces of the super-hard member are placed in a direction virtually orthogonal to the rotational direction of the hammer, with the side faces of the super-hard member being exposed, and wherein a theft is formed in the tip on the front side of the bit body in the rotational direction of the hammer, and build up welding is applied to the theft by using a high-hardness material or a material mixed with high hardness particles.

5. An industrial waste crushing bit according to claim 1 or 4, wherein the bit body is comprised of a flange intermediate the shank and the head, and build up welding is applied to as least the front side of the head and flange in the rotational direction by using a high-hardness material or a material mixed with high-hardness particles.

6. An industrial waste crushing bit according to claim 1 or 4, wherein a mark indicating a limit position beyond which the danger of the super-hard member falling-out of the bit body is expected due to wear of the bit body is provided at least on either one of side faces of the super-hard member in the width direction.

7. An industrial waste crushing bit according to any one of claims 1 to 4, wherein the bit body and the super-hard member are joined to each other by means of brazing.

8. An industrial waste crushing bit for attachment to a hammer of an industrial waste crusher, wherein said hammer is rotated in a specified rotational direction so as to contact and crush waste product to be crushed in the crusher, comprising a bit body having a shank and a virtually conically shaped head at an end of the shank, an opening formed at the tip of the head, and a super-hard member inserted therein, wherein the super-hard member is formed into a virtually plate having front faces and secured to the bit body in such a manner that the front faces of the super-hard member are placed in a direction virtually orthogonal to the rotational direction of the hammer, with the face of the super-hard member in the rotational direction of the hammer being formed into a slanting shape positioned at the tip of the head and having a thickness in the vicinity of the tip of the super-hard member set thicker than a thickness of the base of the super-hard member, and with the front face of the tip of the super-hard member being exposed.

9. An industrial waste crushing bit according to claim 8, wherein the exposed part on the tip of the front face of the super-hard member is made flush with the front face of the bit body.

10. An industrial waste crushing bit according to claim 8, wherein: the bit body is comprised of a flange intermediate the shank and the head, and build up welding is applied to at least the side of the head and flange in the rotational direction by using a high-hardness material or a material mixed with high-hardness particles.

11. An industrial waste crushing bit according to claim 8, wherein a mark indicating a limit position beyond which the danger of the super-hard member falling-out of the bit body is expected due to wear of the bit body is provided at least on either one of the side faces of the super-hard member in the width direction.

12. An industrial waste crushing bit according to claim 8 or 9, wherein the bit body and the super-hard member are joined to each other by means of brazing.

13. An industrial waste crushing bit for attachment to a hammer of an industrial waste crusher, wherein said hammer is rotated in a specified rotational direction so as to contact and crush waste product to be crushed in the crusher, comprising a bit body having a shank and virtually a conically shaped head at an end of the shank, an opening formed at the tip of the head and a super-hard member inserted therein.

wherein the super-hard member is formed into a virtually plate shape having front and side faces and secured to the bit body in such a manner that the front faces of the super-hard member are placed in a direction virtually orthogonal to the rotational direction of the hammer, with the side faces of the super-hard member being exposed, and the bit body is comprised of a flange intermediate the shank and the head, and build up welding is applied to at least the front side of the head and flange in the rotational direction by using a high-hardness material or a material mixed with high-hardness particles.

14. An industrial waste crushing bit for attachment to a hammer of an industrial waste crusher, wherein said hammer is rotated in a specified rotational direction so as to contact and crush waste product to be crushed in the crusher comprising a bit body having a shank and a virtually conically shaped head at an end of the shank, an opening formed at the tip of the head and a super-hard member inserted therein, wherein the super-hard member is formed into a virtually plate shape having front and side faces and secured to the bit body in such a manner that the front faces of the super-hard member are placed in a direction virtually orthogonal to the rotational direction of the hammer, with the side faces of the super-hard member being exposed, the opening has a wall face formed into a tapered shape expanding inward, and the super-hard member is formed into a shape so as to fit the shape of the wall face, and the bit body is comprised of a flange intermediate the shank and the head, and build up welding is applied to at least the front side of the head and flange in the rotational direction by using a high-hardness material or a material mixed with high-hardness particles.

15. An industrial waste crushing bit for attachment to a hammer of an industrial waste crusher, wherein said hammer is rotated in a specified rotational direction so as to contact and crush waste product to be crushed in the crusher, comprising a bit body having a shank and a virtually conically shaped head at an end of the shank, an opening formed at the tip of the head and a super-hard member inserted therein, wherein the super-hard member is formed into a virtually plate shape having front and side faces and secured to the bit body in such a manner that the front faces of the super-hard member are placed in a direction virtually orthogonal to the rotational direction of the hammer, with the side faces of the super-hard member being exposed, the opening has a wall face formed into a shape having a recess inward at least on one side in the width direction of the super-hard member, and the super-hard member is formed into a shape so as to fit the shape of the wall face, and the bit body is comprised of a flange intermediate the shank and the head, and build up welding is applied to at least the front side of the head and flange in the rotational direction by using a high-hardness material or a material mixed with high-hardness particles.

16. An industrial waste crushing bit for attachment to a hammer of an industrial waste crusher, wherein said hammer is rotated in a specified rotational direction so as to contact and crush waste product to be crushed in the crusher, comprising a bit body having a shank and a virtually conically shaped head at an end of the shank, an opening formed at the tip of the head and a super-hard member inserted therein, wherein the super-hard member is formed into a virtually plate shape having front and side faces and secured to the bit body in such a manner that the front faces of the super-hard member are placed in a direction virtually orthogonal to the rotational direction of the hammer, with the side faces of the super-hard member being exposed, and a mark indicating a limit position beyond which the danger of the super-hard member falling-out of the bit body is expected due to wear of the bit body is provided at least on either one of the side faces of the super-hard member in the width direction.

17. An industrial waste crushing bit for attachment to a hammer of an industrial waste crusher, wherein said hammer is rotated in a specified rotational direction so as to contact and crush waste product to be crushed in the crusher, comprising a bit body having a shank and a virtually conically shaped head at an end of the shank, an opening formed at the tip of the head and a super-hard member inserted therein, wherein the super-hard member is formed into a virtually plate shape having front and side faces and secured to the bit body in such a manner that the front faces of the super-hard member are placed in a direction virtually orthogonal to the rotational direction of the hammer, with the side faces of the super-hard member being exposed, the opening has a wall face formed into a tapered shape expanding inward, and the super-hard member is formed into a shape so as to fit the shape of the wall face, and a mark indicating a limit position beyond which the danger of the super-hard member falling-out of the bit body is expected due to wear of the bit body is provided at least on either one of the side faces of the super-hard member in the width direction.

18. An industrial waste crushing bit for attachment to a hammer of an industrial waste crusher, wherein said hammer is rotated in a specified rotational direction so as to contact and crush waste product to be crushed in the crusher, comprising a bit body having a shank and a virtually conically shaped head at an end of the shank, an opening formed at the tip of the head and a super-hard member inserted therein, wherein the super-hard member is formed into a virtually plate shape having front and side faces and secured to the bit body in such a manner that the front faces of the super-hard member are placed in a direction virtually orthogonal to the rotational direction of the hammer, with the side faces of the super-hard member being exposed, the opening has a wall face formed into a shape having a recess inward at least on one side in the width direction of the super-hard member, and the super-hard member is formed into a shape so as to fit the shape of the wall face, and a mark indicating a limit position beyond which the danger of the super-hard member falling-out of the bit body is expected due to wear of the bit body is provided at least on either one of the side faces of the super-hard member in the width direction.

19. An industrial waste crushing bit for attachment to a hammer of an industrial waste crusher, wherein said hammer is rotated in a specified rotational direction so as to contact and crush waste product to be crushed in the crusher, comprising a bit body having a shank and a virtually conically shaped head at an end of the shank, an opening formed at the tip of the head and a super-hard member inserted therein, wherein the super-hard member is formed into a virtually plate shape having front faces and secured to the bit body in such a manner that the front faces of the super-hard member are placed in a direction virtually orthogonal to the rotational direction of the hammer, with the face of the super-hard member in the rotational direction of the hammer being formed into a slanting shape positioned at the tip of the head and having a thickness in the vicinity of the tip of the super-hard member set thicker than a thickness of the base of the super-hard member, and with the front face of the tip of the super-hard member being exposed, the exposed part on the tip of the front face of the super-hard member is made flush with the front face of the bit body, and the bit body is comprised of a flange intermediate the shank and the head, and build up welding is applied to at least the side of the head and flange in the rotational direction by using a high-hardness material or a material mixed with high-hardness particles.

20. An industrial waste crushing bit for attachment to a hammer of an industrial waste crusher, wherein said hammer is rotated in a specified rotational direction so as to contact and crush waste product to be crushed in the crusher, comprising a bit body having a shank and virtually conically shaped head at an end of the shank, an opening formed at the tip of the head and a super-hard member inserted therein, wherein the super-hard member is formed into a virtually plate shape having front faces and secured to the bit body in such a manner that the front faces of the super-hard member are placed in a direction virtually orthogonal to the rotational direction of the hammer, with the face of the super-hard member in the rotational direction of the hammer being formed into a slanting shape positioned at the tip of the head and having a thickness in the vicinity of the tip of the super-hard member set thicker than a thickness of the base of the super-hard member, and with the front face of the tip of the super-hard member being exposed, the exposed part on the tip of the front face of the super-hard member is made flush with a front face of the bit body, and a mark indicating a limit position beyond which the danger of the super-hard member falling-out of the bit body is expected due to wear of the bit body is provided at least on either one of the side faces of the super-hard member in the width direction.

* * * * *